United States Patent [19]

Pires

[11] 4,131,995

[45] Jan. 2, 1979

[54] SMOOTHING COMB FOR A HAIR TRIMMER

[75] Inventor: Antonio Pires, Wallingford, Conn.

[73] Assignee: Sperry Rand Corporation, Bridgeport, Conn.

[21] Appl. No.: 825,333

[22] Filed: Aug. 17, 1977

[51] Int. Cl.[2] ..... B26B 19/20; B26B 19/38

[52] U.S. Cl. ..... 30/200

[58] Field of Search ..... 30/200, 201

[56] References Cited

U.S. PATENT DOCUMENTS

| | | | |
|---|---|---|---|
| 2,778,107 | 1/1957 | Hazelquist | 30/201 |
| 2,867,902 | 1/1959 | Groves | 30/200 |
| 2,941,293 | 6/1960 | Mazzoni | 30/201 |
| 3,046,654 | 7/1962 | Letchfield | 30/201 |
| 3,581,396 | 6/1971 | Broussard | 30/201 |
| 4,074,427 | 2/1978 | Marchetti | 30/201 X |

*Primary Examiner*—Jimmy C. Peters

*Attorney, Agent, or Firm*—Charles R. Miranda; Joseph S. Failla

[57] ABSTRACT

A hair trimming appliance having cutter teeth movable in a reciprocating path is provided with a demountable smoothing comb. The smoothing comb enables trimming of straggling hair strands and cowlicks of a combed hair styling while limiting shearing of hair strands having a predetermined length. The smoothing comb provides for limiting extension of the latter hair strands into the path of the cutter teeth of the hair trimming appliance.

16 Claims, 9 Drawing Figures

SMOOTHING COMB FOR A HAIR TRIMMER

BACKGROUND OF THE INVENTION

This invention relates generally to hair trimming appliances. The invention relates more particularly to powered hair trimming appliances having means for removing odd length and untrained hair strands.

Hand-held powered hair trimmers are known and have been used for trimming a person's hair. In one form of trimmer, a motive force is derived from an electrically energized motor for imparting reciprocating motion to cutter teeth which extend from a segment of the hand-held device. The cutter teeth which travel in a reciprocating path are advanced through the hair style and strands of hair which extend between the teeth during the travel of the cutter teeth are sheared. One such appliance which provides for limiting the length of hair being cut is disclosed in copending U.S. patent application Ser. No. 825,335 filed concurrently herewith and which is assigned to the assignee of this invention.

At times it is desirable to smoothly trim a hair style or a beard by removing straggling hair strands or cowlicks which resist conforming to a combed hair style. This type of trimming of a hair style has previously been accomplished by manual barbering techniques which require a degree of skill acquired only after extended practice. Known hand-held, powered hair trimmers are unsatisfactory in the performance of this trimming operation by untrained users since a high degree of control skill is necessary, particularly in view of the rapid shearing action of powered cutter teeth which can result in an undesired alteration of the hair style.

Accordingly, it is an object of this invention to provide a means for smoothing a hair style, a beard of the like with a powered hair trimmer.

Another object of the invention is to provide a means for operating a powered hair trimmer as a smoothing hair trimmer.

Another object of the invention is to provide a means for use with a power hair trimmer which facilitates the smoothing of a hair style by the removal of straggling hair strands and cowlicks.

SUMMARY OF THE INVENTION

In accordance with features of the invention there is provided an improved hand-held powered hair trimmer for smoothing a hair style. The trimmer includes a plurality of cutter teeth for shearing hair strands which extend between the teeth as the cutter teeth are advanced through the hair style. A comb means is provided and is demountably positioned on the hair trimmer for transport therewith through the hair style. The comb means is adapted to guide hairs past the cutter teeth and to selectively limit the trimming of hair strands having a length greater than a predetermined length. Relatively short, straggling hair strands and cowlicks are thereby guided past the cutter teeth and are sheared while trimming of longer hair strands of the hair styling is substantially limited.

In accordance with more particular features of the invention, the comb means comprises a comb body having an array of parallel aligned runners extending therefrom and on which the trimmer is guided over a hair style. The body includes segments having surface means for limiting hair strands between the runners from the extension into the path of the cutter teeth to restrict trimming of hairs having a length equal to or greater than a predetermined length.

BRIEF DESCRIPTION OF THE DRAWINGS

These and other objects and features of the invention will become apparent with reference to the following specification and to the drawings wherein.

DETAILED DESCRIPTION

Figure 1:
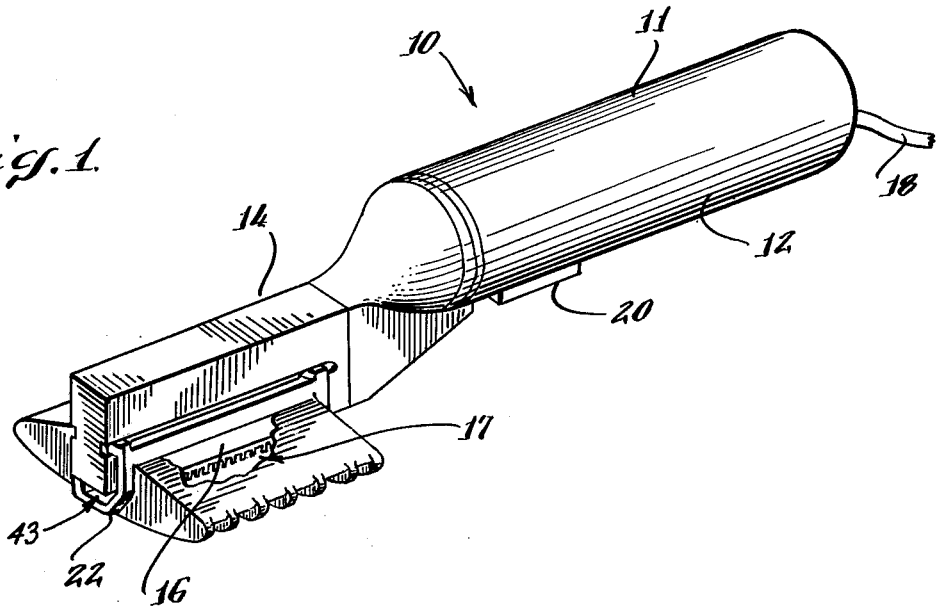
FIG. 1 is a perspective view of a hand-held, powered hair trimmer constructed in accordance with features of the invention.
Figure 2:
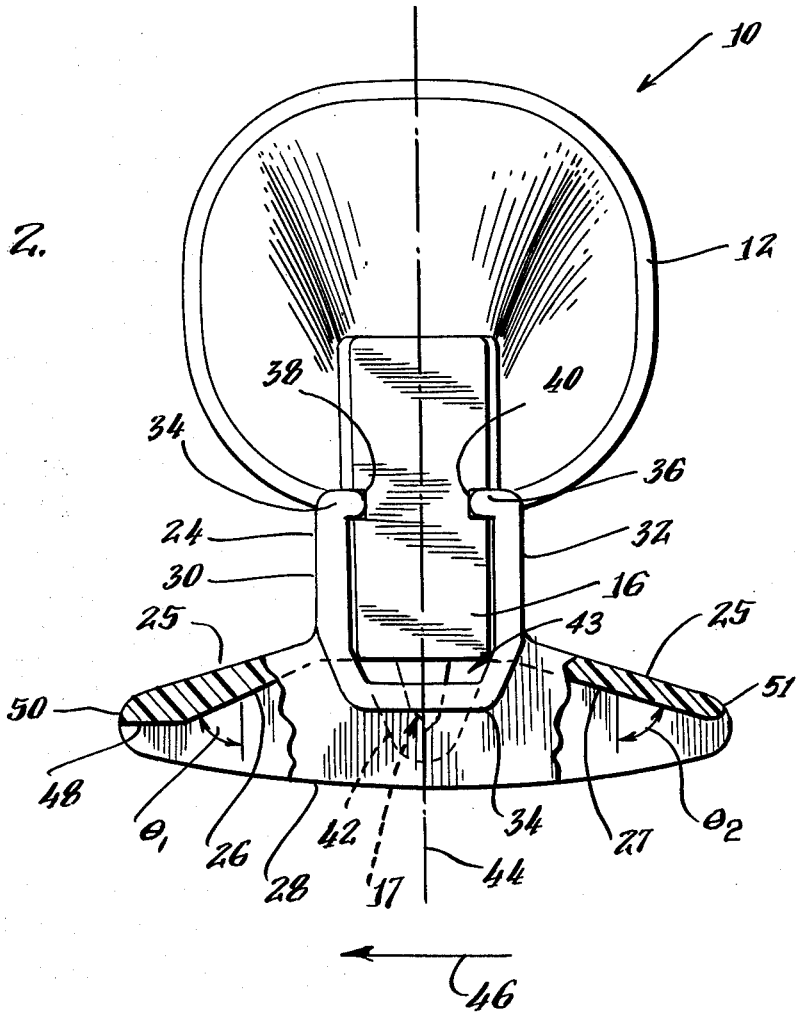
FIG. 2 is an enlarged front elevational view, partly broken away, of the hair trimmer of FIG. 1.
Figure 3:
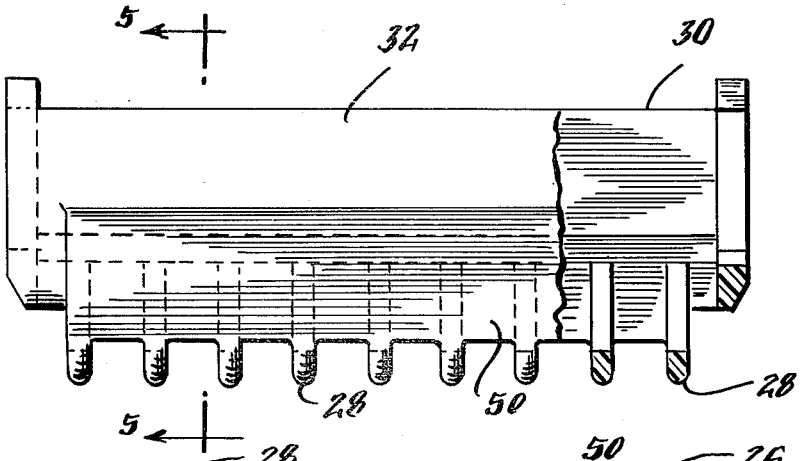
FIG. 3 is an enlarged side view, partly broken away, of a smoothing comb attachment for use with the powered hair trimmer of FIG. 1.

Referring now to FIG. 1, a powered hair trimmer, referred to generally by reference numeral 10, is shown to have an elongated hand-held trimmer case 11. Case 11 includes a first case or handle member 12 for housing an electrical drive means and a second case or timmer support member 14 for supporting a cutter assembly which is referred generally as 16 (FIG. 2). The cutter assembly comprises a toothed stationary cutter and a toothed movable cutter in juxtaposed relationship and defining therebetween a cutting plane 44. The cutter teeth referred to generally by reference numeral 17 form an elongated row of cutter teeth which extend in the direction of the length of trimmer 10. The hair trimmer is electrically powered by an electric motor (not illustrated) positioned within the handle member 12 and is energized by batteries similarly positioned within handle member 12, or, alternatively by A.C. power applied from the line source via input line 18. The electric motor is energized by operation of a slide switch 20. Rotary motion of a motor rotor (not illustrated) is converted to reciprocating motion and is coupled to cutter assembly 16 for causing the teeth of the movable cutter to move in a reciprocating path with respect to the teeth of the stationary cutter. As cutter assembly 16 is transported through a hair styling, those hairs which extend between cutter teeth 17 will be sheared. A cutter assembly 16 is described in greater detail in the aforementioned U.S. patent application, the disclosure which is incorporated herein by reference.

A comb means is provided and is demountably positioned on the hair trimmer for transport therewith. The comb means is adapted to guide hair strands past cutter teeth 17 and to limit the extension of guided hair strands between cutter teeth 17 thereby restricting the trimming of strands having a length equal to or greater than a predetermined length. The comb means comprises a comb body 22 having a comb support member 24, a body segment 25 having surfaces 26 and 27, and a plurality of runners 28 which are arranged in a longitudinal array. The array of runners extends in the direction of the row of cutter teeth 17 and runners 28 extend in a transverse direction with respect to the direction of the row of cutter teeth 17. In a preferred arrangement as illustrated, comb support 24, surfaces 26 and 27, and the array of runners 28 are integrally formed of a polymer plastic material as, for example, LEXAN.

Comb support 24 provides a means for mounting body 22 to trimmer support 14 and for positioning the comb runners with respect to the trimmer teeth in order to guide hair strands past the cutter teeth upon transport of the comb through a hair styling. Comb support 24 is elongated and includes a pair of walls 30 and 32 extending from surfaces 26 and 27 respectively. Comb support 24 has a channel shaped configuration including projections 34 and 36 which engage longitudinally extending grooves 38 and 40 respectively formed in trimmer support 14. Fabrication of the comb body of a polymer plastic imparts a resilience to walls 30 and 32 thereby permitting a deflection of these walls for positioning of comb support 24 about trimmer support member 14 and engagement of projections 34, 36 with grooves 38, 40 respectively. Each of runners 28 has a recess 42 formed therein. Each recess 42 being aligned with each other forming an elongated recess 43 extending longitudinally of the comb body across runners 28. The longitudinal row of cutter teeth 17 extend from cutter assembly 16 along the length of the elongated recess 43 and depend into recesses 42 formed in runners 28. As the hand-held trimmer with the attached comb means is advanced through a hair styling, strands of hair will be guided by runners 28 past the tips of cutter teeth 17.

Figure 4:
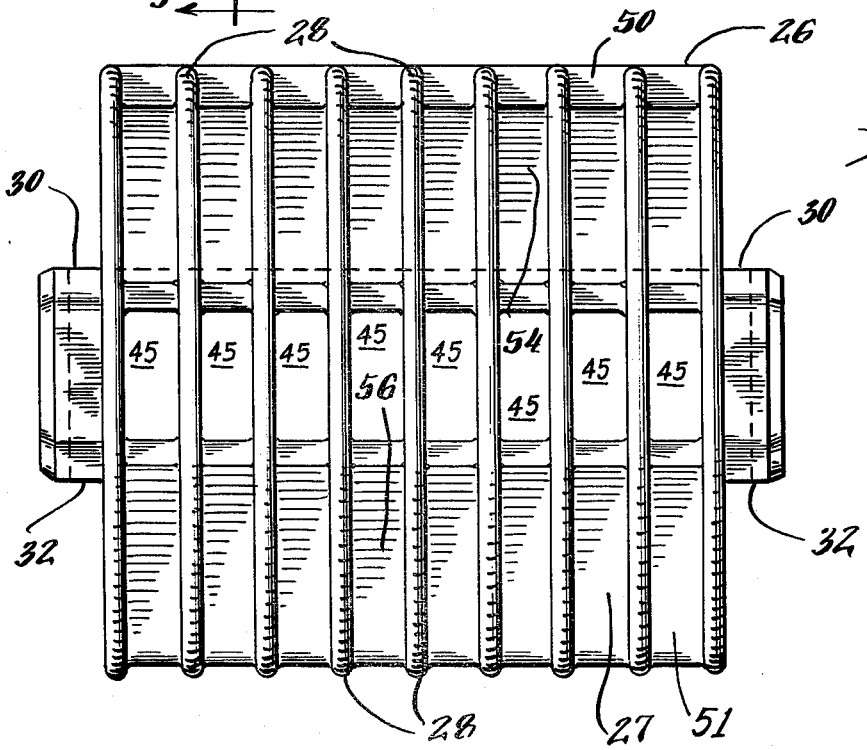
FIG. 4 is a bottom view of the smoothing comb attachment of FIG. 3.
Figure 5:
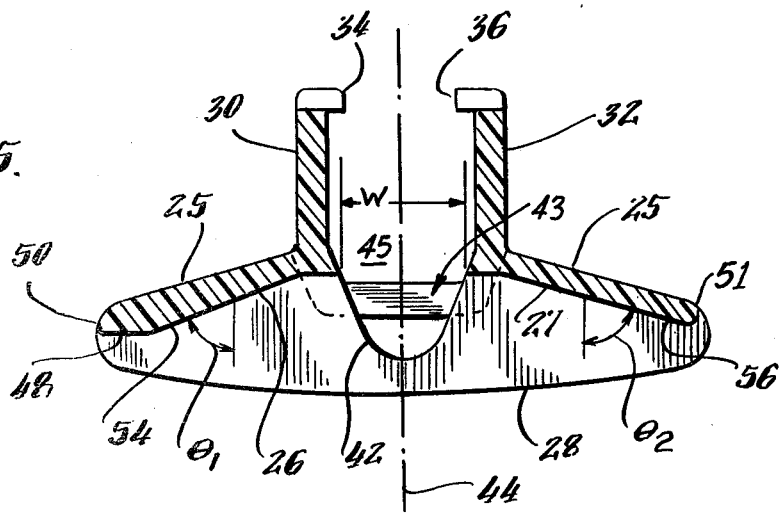
FIG. 5 is a view taken along line 5—5 of FIG. 3.

A means for limiting the extension of hair segments between the cutter teeth and thereby restricting the trimming of hair segments having a length greater than a predetermined length is provided by body surfaces 26 and 27. This limitation on the extension of hair strands between the cutter teeth is provided by the configuration of surfaces 26, 27, the displacement (W) forming gaps 45, as best seen in FIG. 4, between these surfaces, and the angular orientation $\theta_2$ and $\theta_2$ of the body surfaces with respect to cutting plane 44 of the row of cutter teeth 17. Gaps 45 are longitudinally spaced from each other by runners 28 spanning the width of elongated recess 43 and cutter teeth 17 and are in open communication therewith. In general, these characteristics are adapted to limit relatively longer hair strands from extending into the path of cutter teeth 17 thereby restricting the extent of trimming of the longer hair strands. Body surface 26 has a configuration or orientation with respect to cutting plane 44 for initially spacing a relatively long hair strand away from cutter teeth 17 as the hair strand is guided toward the cutter teeth during advancing motion of the trimmer indicated by arrow 46. As illustrated in FIG. 2, body surface 26 is formed at an angle $\theta_1$ with respect to cutting plane 44. Body surface 26 is also configured to include an integrally formed shoulder segment 48 having a rounded leading edge 50. Body surface 27 having a rounded leading edge 51 is similarly formed at an angle $\theta_2$ with respect to cutting plane 44.

Figure 6:
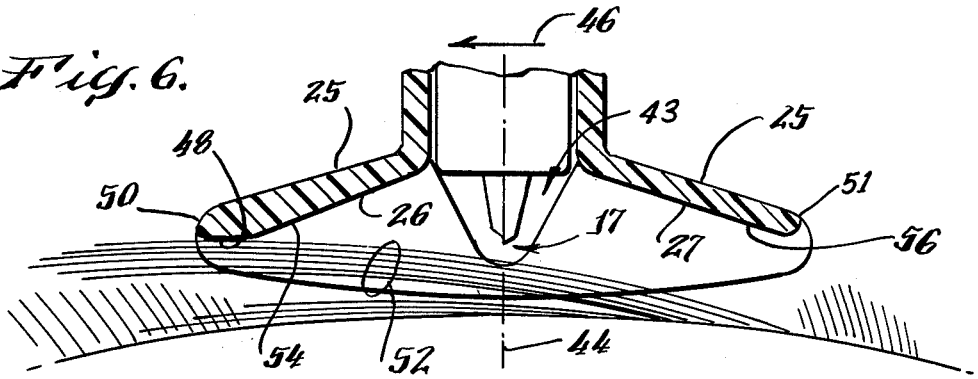
FIGS. 6–9 illustrate the trimming operation of the hair trimmer of FIG. 1 as it is advanced through a hair styling.
Figure 7:
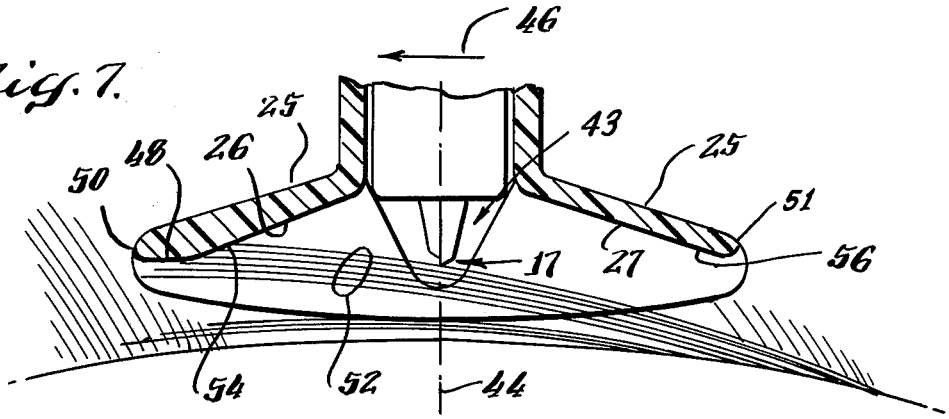

The operation of the comb means in limiting the extension of hair strands having a length greater than the predetermined length between cutter teeth 17 thereby restricting the trimming of the strands is best illustrated with reference to FIGS. 6–9. In FIG. 6, the trimmer is shown being advanced to the left and a plurality or bundle of relatively long hair strands 52 are guided between adjacent runners 28. These hair strands conform to the hair style and it is desirable that trimming of these is limited. It can be seen in FIG. 6 that hair strands 52 are maintained away from the tips of the row of cutter teeth 17 by shoulder segment 48 as the trimmer advances through the hair styling. The extension of hair strands 52 between cutter teeth 17 is thereby limited. As the trimmer continues its motion toward the left, as viewed in FIG. 7, shoulder segment 48 is advanced past the end segments and tips of hair strands 52. These strands then flex upwardly and contact a lower portion portion 54 of body surface 26. The strands are still maintained at a spaced away position with respect to cutter teeth 17 although they have advanced to a more proximate location with respect to the tips of cutter teeth 17. As the trimmer continues its advance through the hair styling, hair strands 52, because of their length, will bridge across the gap 45 existing between lower portion 54 of surface 26 and a lower portion 56 of surface 27. This bridging maintains the hairs at a spaced away location from cutter teeth 17 when the end segments of hair strands 52 part contact with lower portion 54. As the tips of the row of comb teeth 17 traverses the end segments of hair strands 52, a substantially restricted trimming of the distal segments of these hair strands occurs when the progress of the trimmer reaches the point where bridging is no longer effective and these distal segments flex into the path of cutter teeth 17. However, the length of the distal segments thus trimmed is relatively small compared to the overall length of hair strands 52. The extension of hair strands between cutter teeth 17 is thus limited and the trimming of these hair strands is restricted to relatively short distal segments.

Figure 8:
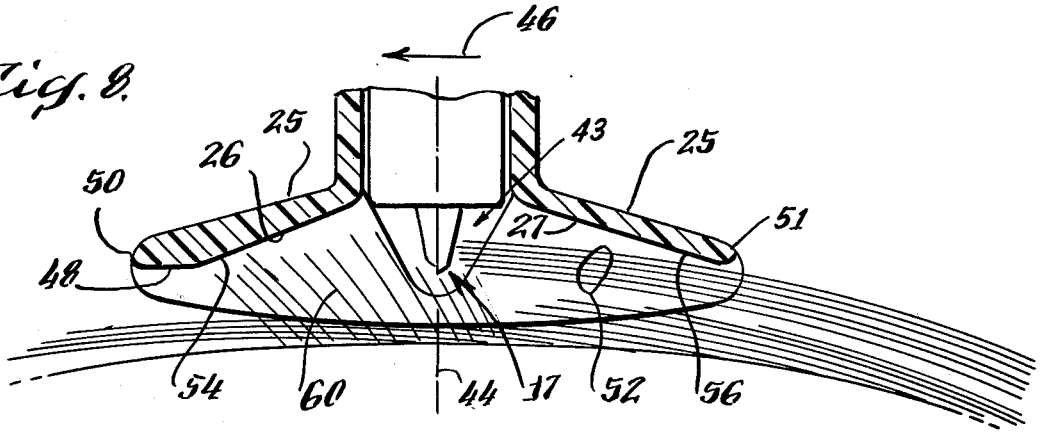
Figure 9:
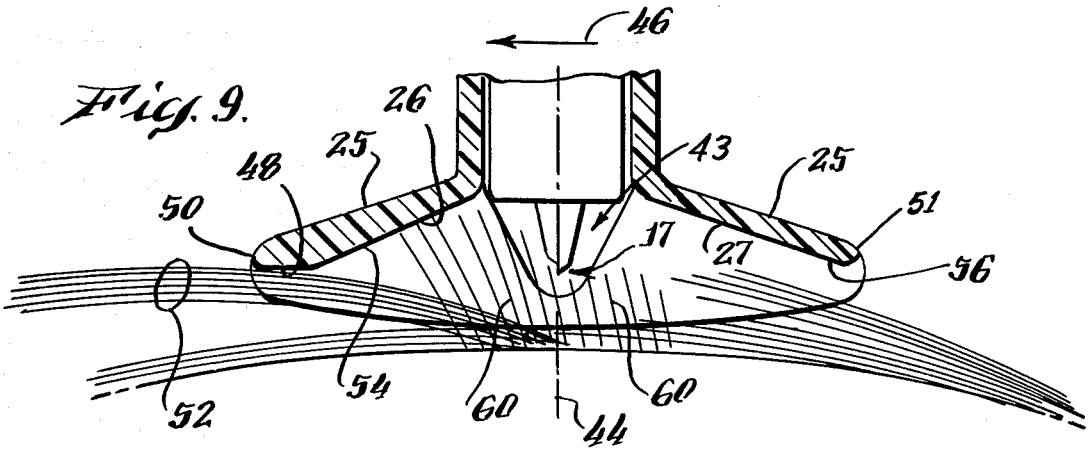

On the other hand, as illustrated in FIGS. 8 and 9, various untrained hair strands and cowlicks 60 do not conform with the hair style; they experience little if any restraining forces; and they are free to flex into the path of the cutter teeth and to be sheared. The trimmer thus operates to trim untrained and unruly hair strands and cowlicks while trimming of relatively longer trained hair strands is restricted.

The limited extension of the hair strands 52 into the path of cutter teeth 17 and the restricted trimming thereof is effective for hair strands having a length greater than a predetermined length. This length (L) is determined by the configuration of body surfaces, 26 and 27, the angular orientation of these surfaces with respect to cutting plane 44 and spacing (W) of gaps 45 between the surfaces. In general, when angles $\theta_1$ and $\theta_2$ (FIG. 2) are made smaller, length (L) becomes smaller. Conversely, as angles $\theta_1$ and $\theta_2$ are made larger, length (L) is increased. Accordingly, by varying these angles, the length of hair (L) which can be restrictively trimmed is controlled. For given angles $\theta_1$ and $\theta_2$, increasing width (W) will increase length (L) while decreasing width (W) will similarly decrease length (L). Angles $\theta_1$ and $\theta_2$ can be effectively reduced by the particular configuration of surfaces 26 and 27 respectively. More particularly, shoulder segment 48 causes the hair strands to be spaced further away from lower portion 54 than will be effected by lower portion 54 along. This effectively reduces angle $\theta_1$ and provides for restricted cutting of shorter hair lengths for a given angle $\theta_1$. Body surface 27 can similarly be configured independently or in combination with various configurations of body surface 26. Similarly, various combinations of angles $\theta_1$ and $\theta_2$, width (W) and configurations of the body surfaces can be selected to achieve a desired length (L) of hair strands having restricted trimming.

The configuration shown for body surface 26 is more restrictive and smaller distal segments of hair strands are trimmed as compared to the configuration shown for body surface 27.

If longer distal segments of hair strands 52 are desired to be trimmed the direction of advance shown in FIG. 6 is reversed and leading edge 52 of body surface 27 is advanced over the hair styling. As leading edge 51 is advanced over the hair styling without the limitation imposed by shoulder 48 on the ends of the hair strands more of the hair strand ends will flex upwardly and engage cutter teeth 17 before the aforementioned bridging occurs.

The use of runners 28 and rounding of the leading edge of shoulder segment 48 permits the comb body to glide over a cushion of hair in the hair style without penetrating to the scalp thereby providing a relatively comfortable feel for the comb body as it advances through the hair style. The spacing between runners 28 provides for guiding straggling hair strands toward the centrally located cutter teeth for extension of these strangling hair ends between the cutter teeth. The lower portions 54 and 56 of surfaces 26 and 27 suppress the non-strangling relatively long hair strands and maintain them in a bridged relationship referred to hereinbefore with respect to the tips of cutter teeth 17 thereby limiting the extension of the relatively longer hair strands between the cutter teeth and restricting trimming thereof.

An improved hair trimmer device has thus been described which advantageously provides for trimming uncontrolled unruly hair strands and cowlicks while substantially restricting the trimming of conforming hair strands of predetermined length.

While there has been described a particular embodiment of the invention, it will be appreciated by those skilled in the art that variations may be made thereto without departing from the spirit of the invention and the scope of the appended claims.

What is claimed is:

1. An improved power driven hair trimmer for smoothing hair comprising;

a. a power driven hair trimmer;

b. said hair trimmer having a cutter including an elongated row of cutter for shearing hair which extend between said teeth;

c. a comb member demountably positioned on said hair trimmer for transport therewith;

d. said comb member including an elongated recess formed therein, said comb member being positioned on said hair trimmer with the elongated row of cutter teeth depending into said recess and extending longitudinally thereof, guide means extending transversely of the recess for guiding hair strands past said row of cutter teeth, and limiting means transversly displaced with respect to said elongated recess and located between said guide means for limiting extension of guided hair strands into said recess and between said cutter teeth for restricting the trimming of guided hair strands having a length greater than a predetermined length which bridge said recess.

2. The hair trimmer of claim 1 wherein said limiting means include transversely displaced limiting surfaces and said row of cutter teeth extends into said elongated recess between said limiting surfaces and said surfaces are formed and spaced for limiting the extension between said cutter teeth of hair strands having a length greater than a predetermined length.

3. The hair trimmer of claim 1 wherein said guide means comprise a plurality of runners spaced longitudinally with respect to said elongated recess, said elongated recess being formed in said runners, said limiting means comprise a plurality of limiting surfaces located between the runners and transversely displaced with respect to said elongated recess, said transverse displacement of the limiting surfaces forming a plurality of gaps in open communication with and spanning the width of said elongated recess between the runners.

4. The hair trimmer of claim 3 wherein one of said surfaces is configured for limiting extension of hiar strands between said cutter teeth.

5. The hair trimmer of claim 4 wherein said configuration comprises an integrally formed shoulder segment having a planar surface positioned at an edge of said limiting surface.

6. The hair trimmer of claim 3 wherein a cutting plane extends through said row of cutter teeth and said limiting surfaces are orientated at angles relative to said cutting plane for limiting the extension of hair strands between said cutter teeth.

7. The hair trimmer of claim 3 wherein said limiting surfaces are spaced apart a distance (W) for limiting the extension of hair strands between said cutter teeth.

8. An improved electrically energized hair trimming appliance comprising;

a. a cutter means having in juxtaposed relationship a row of stationary cutter teeth and a row of movable cutter teeth operable for movement in a reciprocating path relative to said row of stationary cutter teeth;

b. a comb member having an elongated recess formed therein and demountably positioned on said appliance with said rows of juxtaposed cutter teeth depending into and extending longitudinally of said recess for transport therewith;

c. guide means on said comb member extending transversely of said recess for guiding hair strands of a hair styling across the reciprocating path of said rows of cutter teeth, and d. means formed on said comb member between said guide means and transversely displaced with respect to said recess for limiting hair strands having a length greater than a predetermined length which bridge the recess from extending into said recess and the reciprocating path of said rows of cutter teeth.

9. The appliance of claim 7 wherein said guide means include runners having a length thereof formed on said comb member and extending in a direction transverse to said rows of cutter teeth.

10. The appliance of claim 9 wherein a plurality of said runners form an array extending in a direction parallel to said rows of cutter teeth.

11. The appliance of claim 9 wherein said means for limiting hair strands comprise surfaces formed in said comb member extending between said runners in a direction parallel thereto.

12. The appliance of claim 11 wherein said row of stationary cutter teeth and said row of movable cutter teeth form a cutting plane extending therebetween and said limiting surfaces comprise planar surfaces oriented at angles relative to said cutting plane.

13. The appliance of claim 11 wherein said limiting surfaces are interrupted by a gap formed in said comb member in open communication with said elongated recess and said rows of cutter teeth, said rows of cutter teeth extend into said gap in a direction transverse to said limiting surfaces.

14. The appliance of claim 12 wherein said planar surfaces are interrupted by a gap formed in said comb member in open communication with said elongated recess and said cutting plane extending into said gap in a direction transverse to said planar surfaces.

15. The appliance of claim 14 wherein said interrupted planar surfaces comprise a pair of planar surfaces spaced at either side of said gap and each of said planar surfaces is oriented at an angle relative to said cutting plane.

16. A smoothing comb attachable to a hair trimmer, said hair trimmer comprising, a cutter having an elongated row of cutter teeth for trimming hairs which extend between said cutter teeth, said smoothing comb comprising;

a. a comb member having an elongated recess formed therein;

b. means extending from said comb members adjacent said recess for demountably positioning the comb member on the hair trimmer with the elongated row of cutter teeth depending into and extending longitudinally of the elongated recess;

c. a plurality of guide members formed on said comb member extending transversely of the elongated recess and longitudinally spaced from each other for guiding hair strands therebetween and across said recess, d. a plurality of limiting surfaces formed on said comb member between said guide members, said limiting surfaces being transversely displaced with respect to the elongated recess and forming a plurality of gaps across the recess between the guide members, and e. said limiting surfaces restricting entry into said gaps of longer guided hair strands which bridge said gaps, and non-bridging hair strands entering the gaps for extension into the cutter teeth for trimming thereby.

* * * * *

UNITED STATES PATENT AND TRADEMARK OFFICE

CERTIFICATE OF CORRECTION

PATENT NO. : 4,131,995

DATED : January 2, 1979

INVENTOR(S) : Antonio Pires

It is certified that error appears in the above-identified patent and that said Letters Patent are hereby corrected as shown below:

IN THE CLAIMS

Claim 1, line 5, after "cutter" insert -- teeth --;

Claim 3, line 4, after "formed in" insert -- the comb member by a plurality of aligned recesses formed in --

Signed and Sealed this

*Twenty-fourth* Day of *April 1979*

[SEAL]

*Attest:*

RUTH C. MASON
*Attesting Officer*

DONALD W. BANNER
*Commissioner of Patents and Trademarks*